US005669785A

United States Patent [19]

Hammer et al.

[11] Patent Number: 5,669,785

[45] Date of Patent: Sep. 23, 1997

[54] ELECTRICAL CONNECTION TERMINAL ARRANGEMENT

[75] Inventors: Dieter Hammer, Waiblingen; Bernhard Albeck, Lorch-Waldhausen; Karl Biebl, Stuttgart, all of Germany

[73] Assignee: Vossloh Schwabe GmbH, Urbach, Germany

[21] Appl. No.: 658,632

[22] Filed: Jun. 5, 1996

Related U.S. Application Data

[63] Continuation of Ser. No. 227,613, Apr. 14, 1994, Pat. No. 5,575,679.

[30] Foreign Application Priority Data

Apr. 20, 1993 [DE] Germany ..... 43 12 778.9

[51] Int. Cl.[6] ..... H01R 4/24

[52] U.S. Cl. ..... 439/396; 439/439

[58] Field of Search ..... 439/395–404, 439/411, 418, 441, 438, 860, 439, 440

[56] References Cited

U.S. PATENT DOCUMENTS

| | | | |
|---|---|---|---|
| 4,557,544 | 12/1985 | Esser | 439/395 |
| 4,808,122 | 2/1989 | Tomizu et al. | 439/395 |
| 4,909,754 | 3/1990 | Paradis | 439/395 |
| 4,952,169 | 8/1990 | Hayes, Sr. | 439/403 |
| 5,006,077 | 4/1991 | Loose et al. | 439/395 |
| 5,006,277 | 4/1991 | Loose et al. | 439/395 |
| 5,011,429 | 4/1991 | Ku | 439/441 |
| 5,061,203 | 10/1991 | Allgood et al. . | |
| 5,133,673 | 7/1992 | Dijkshoorn | 439/860 |
| 5,147,218 | 9/1992 | Matthews et al. . | |
| 5,292,260 | 3/1994 | Sinisi et al. | 439/441 |
| 5,415,563 | 5/1995 | Shan et al. | 439/439 |

FOREIGN PATENT DOCUMENTS

| | | | |
|---|---|---|---|
| 353 352 | 11/1979 | Austria . | |
| 0 002 099 A1 | 5/1979 | European Pat. Off. . | |
| 0 109 297 A1 | 5/1984 | European Pat. Off. . | |
| 0 382 039 | 8/1990 | European Pat. Off. . | |
| 0 392 422 A1 | 10/1990 | European Pat. Off. . | |
| 2 333 361 | 6/1977 | France . | |
| 2127858 | 2/1970 | Germany | 439/418 |
| 22 44 158 | 3/1974 | Germany . | |
| 2653593 | 2/1977 | Germany | 439/418 |
| 26 41 461 | 4/1977 | Germany . | |
| 79 02 093 | 7/1979 | Germany . | |
| 30 24 249 | 1/1982 | Germany . | |
| 3112301 | 10/1982 | Germany | 439/438 |
| 87 10 307.9 | 10/1987 | Germany . | |
| 90 07 074.7 | 10/1990 | Germany . | |
| 43 06 795 | 9/1994 | Germany . | |
| 3-15465 | 2/1991 | Japan . | |
| 0659918 | 2/1987 | Switzerland | 439/441 |
| 2 013 994 | 8/1979 | United Kingdom . | |
| 2 112 217 | 7/1983 | United Kingdom . | |

*Primary Examiner*—Neil Abrams
*Assistant Examiner*—Brian J. Biggi
*Attorney, Agent, or Firm*—Frishauf, Holtz, Goodman, Langer & Chick, P.C.

[57] ABSTRACT

An electrical connection terminal arrangement has a housing (1) of insulating material, in which at least one slit-blade insulation-piercing contact is located that is formed on a contact spring (17). The contact spring is additionally provided with at least one plug contact (27) and one apparatus connection contact (29).

17 Claims, 9 Drawing Sheets

Fig.6
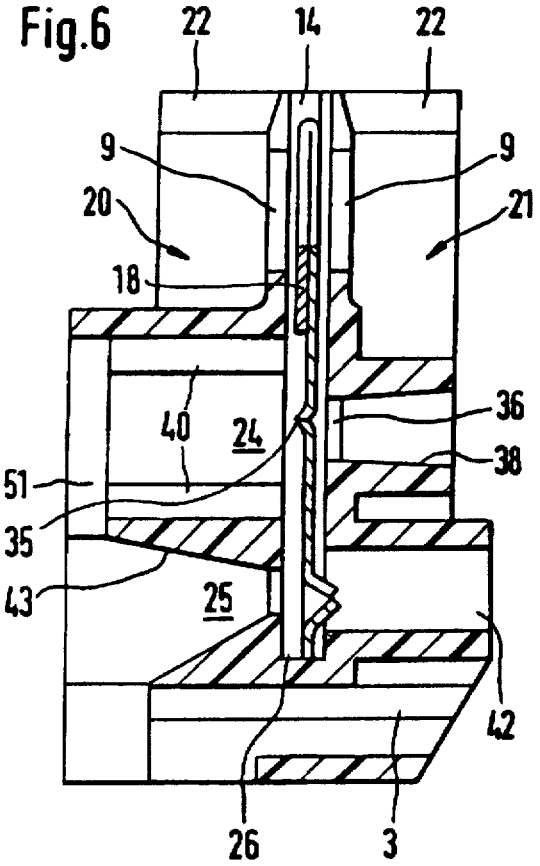
Fig.7
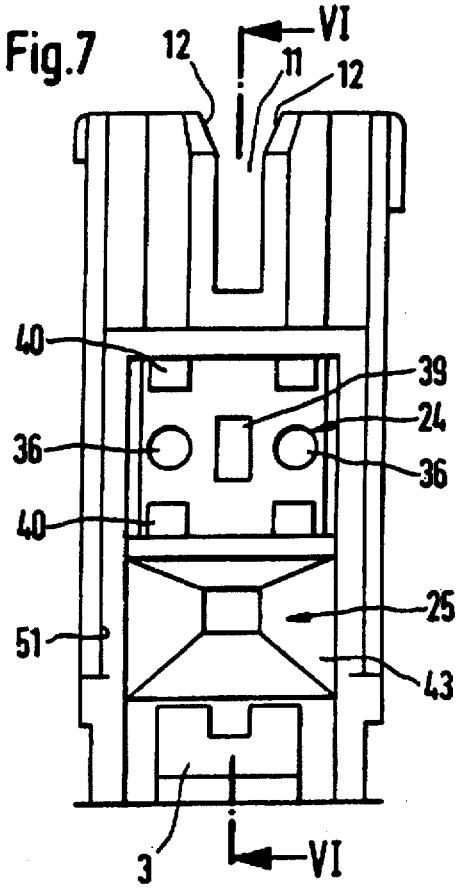
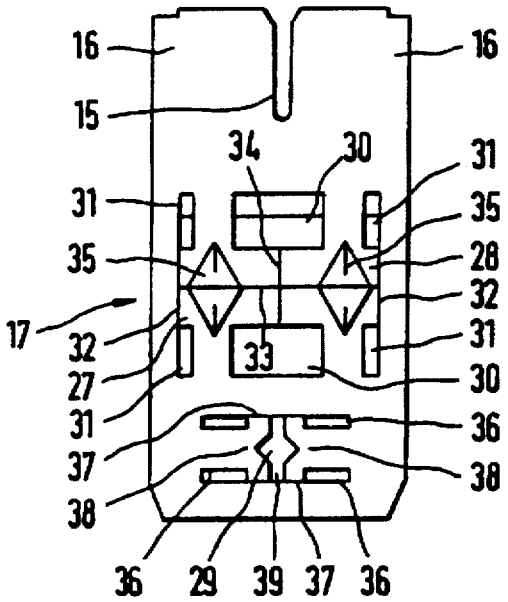
Fig.8
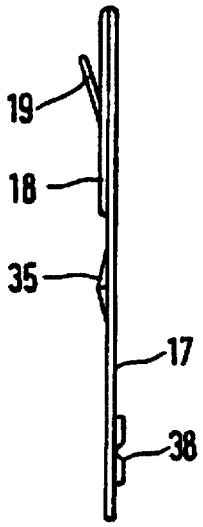
Fig.9

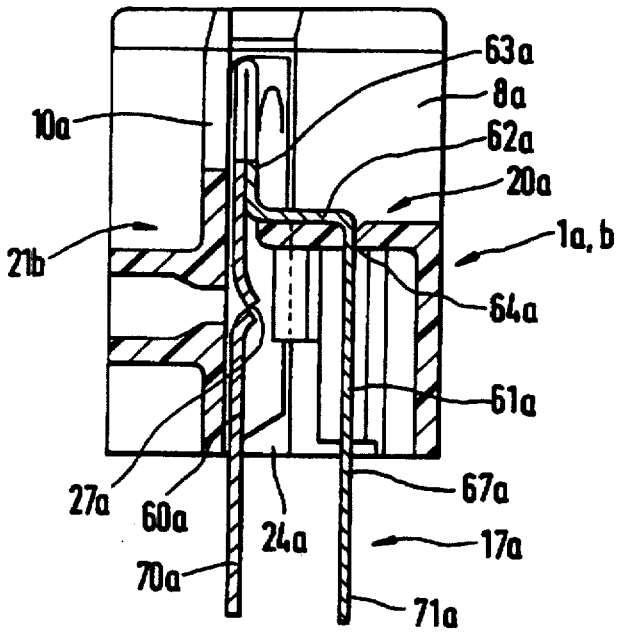
Fig.14
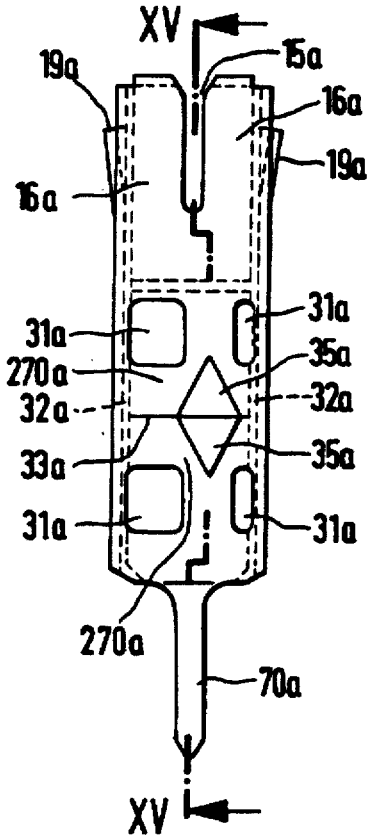
Fig. 16
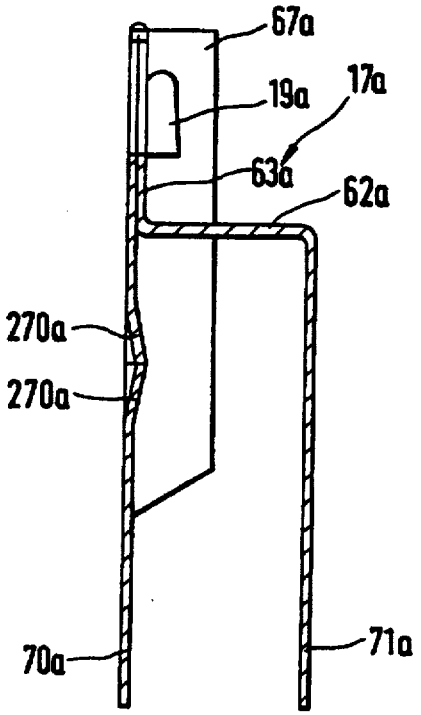
Fig.15
Fig.17
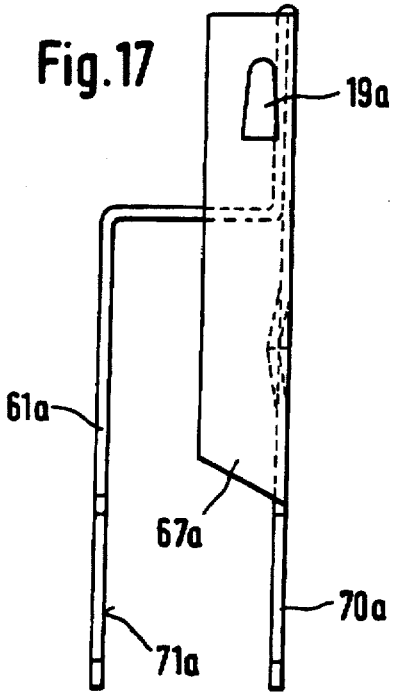

ELECTRICAL CONNECTION TERMINAL ARRANGEMENT

This is a continuation of Ser. No. 08/227,613, filed Apr. 14, 1994, now U.S. Pat. No. 5,575,679.

Reference to related application, the disclosure of which is hereby incorporated by reference:

U.S. application Ser. No. 08/230,056, filed Apr. 20, 1994 of Mews et al, now U.S. Pat. No. 5,480,323, issued Jan. 2, 1996.

Reference to related publications:

EP 002 099, Leidy et al;

DE-OS 23 30 159

DE-PS 22 44 158, Albeck.

FIELD OF THE INVENTION

The invention relates to an electrical connection terminal arrangement having a housing of insulating material, which has at least one insertion slit, open at the edge toward one insertion side, for an electric wire and at least one slit-blade insulation-piercing connector, or contact, forming a contact zone and located in the housing, with a slit-blade insulation-piercing slit open at the edge and aimed at the insertion slit for wire connection, wherein the slit-blade insulation-piercing contact is formed on a contact spring.

BACKGROUND

Electrical connection terminal arrangements of this kind, for instance in the form of connection terminals or terminal strips, enable contacting of the conductors by what is known as the slit-blade insulation-piercing technique. This technique offers considerable advantages, especially in automatic production of wiring layouts for apparatus, such as fixtures or luminaires, because it requires no separate actuation of clamping devices such as screws or the like.

Besides connecting terminals for connecting conductors, it is also known to equip connection terminal arrangements for electrical apparatus with slit-blade insulation-piercing contacts of this kind. One example is described in EP 002 099, Leidy et al. A housing made of insulating material is mounted on the lamination packet of a transformer, and a plurality of slit-blade insulation-piercing contacts for conductor connection are located in the housing. Each of these slit-blade insulation-piercing contacts is formed on an approximately U-shaped contact spring, which is provided with two insulation piercing slits on opposed sides, the dimensions of the slits being adapted for the connection of a winding wire on one side and a network supply line on the other. Basically, these are connecting clamps of two lines of different diameter, both of which are connected to the contact spring by the slit-blade insulation-piercing technique.

THE INVENTION

It is an object to provide a connector which is simple and preferably has even more-universal utility as a connection arrangement made by the slit-blade insulation-piercing technique, suitable especially for automatic production of wiring layouts. Briefly, the contact spring has in addition to the slit blade insulation-piercing connector, or contact at least one plug contact and a contact for an apparatus, herein termed accessory apparatus, connection.

Suitably, the plug contact is formed with a disconnectable conductor connection, so that a connection line contacted here, for instance for an additional device such as a capacitor in wiring a light fixture or luminaire, can selectively be disconnected again. On the other hand, it is often advantageous if the apparatus connection contact is arranged for non-disconnectable connection of a connection part of the apparatus, so that the connection device can no longer be removed from the apparatus by the user. The apparatus connection can moreover advantageously be a plug contact, although it is also possible to form it in some other way, for example as a solder or base pin.

As a rule, the plug contact is formed by cut-out tabs in the contact spring that spread apart when the part to be connected is mounted; these tabs lock to the part to be connected and clamp it securely to the contact spring, producing a highly conductive electrical contact.

By suitable embodiment of the parting lines and suitable shaping of the tabs, the plug connection can be made either disconnectable or nondisconnectable. If it is to be disconnectable, then an unlocking region that is accessible from outside the apparatus with a disconnection tool is assigned to it on the contact spring; the tabs are formed to be elastically deformable in the disconnection direction by a pressure force acting upon the contact spring in the unlocking region. As a rule, and in the conventional way, a screwdriver is used as the disconnection tool.

DRAWINGS

Figure 1:
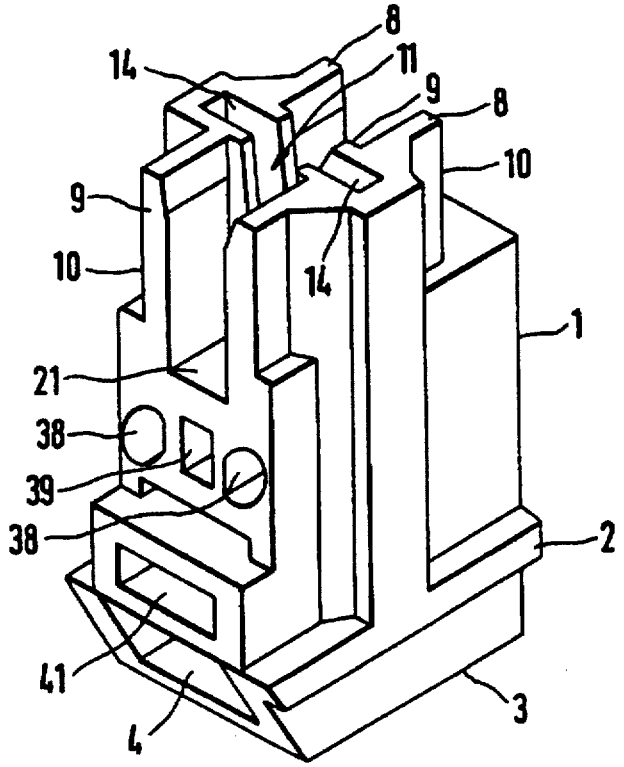
FIG. 1 is a perspective view of the housing of a connection device according to the invention, in the embodiment as a simple, single-phase apparatus connection terminal.
Figure 3:
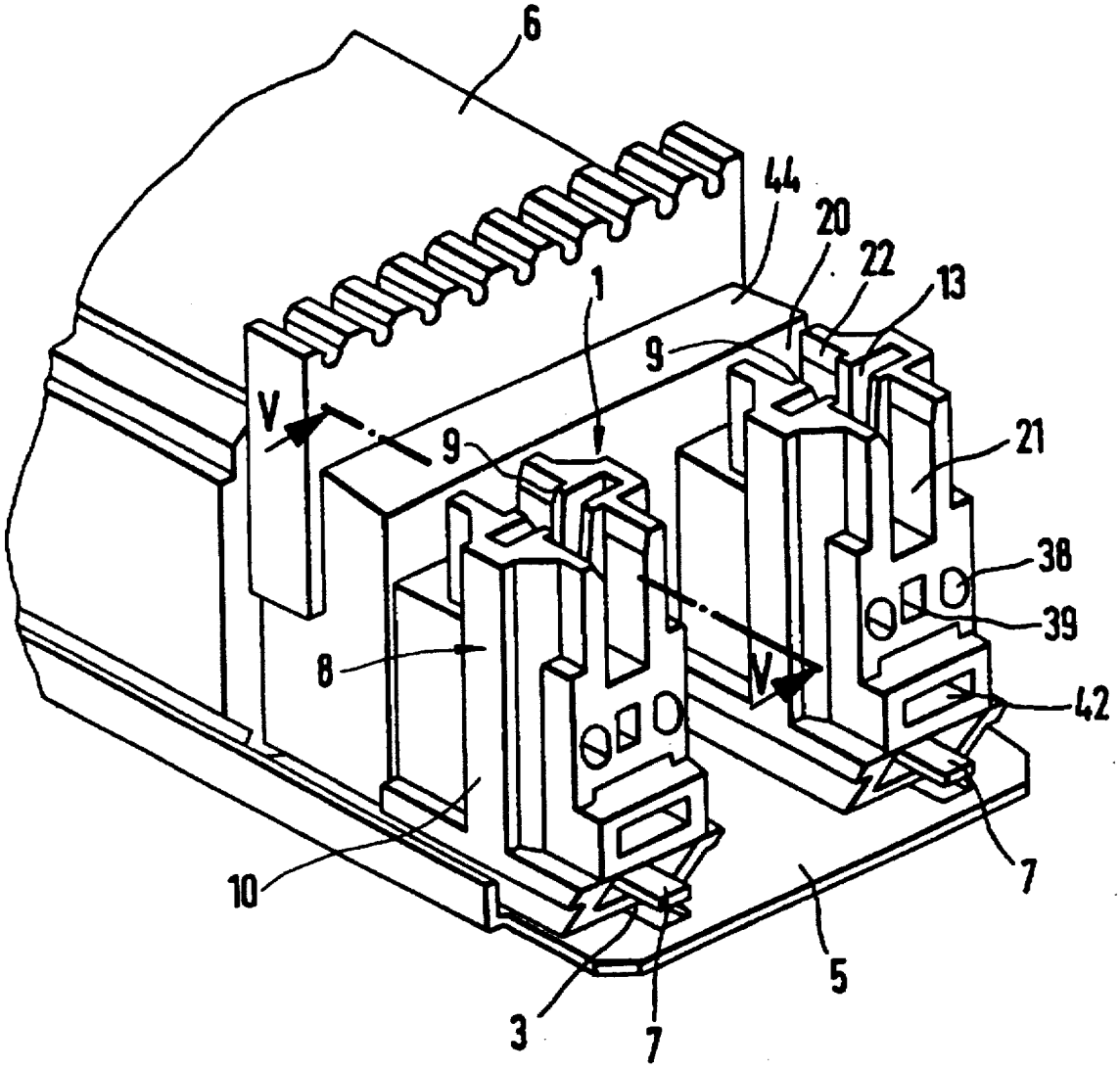
FIG. 3 is a perspective schematic fragmentary view of two connection terminals of FIG. 1, in combination with an accessory circuit system for gas discharge lamps.
Figure 5:
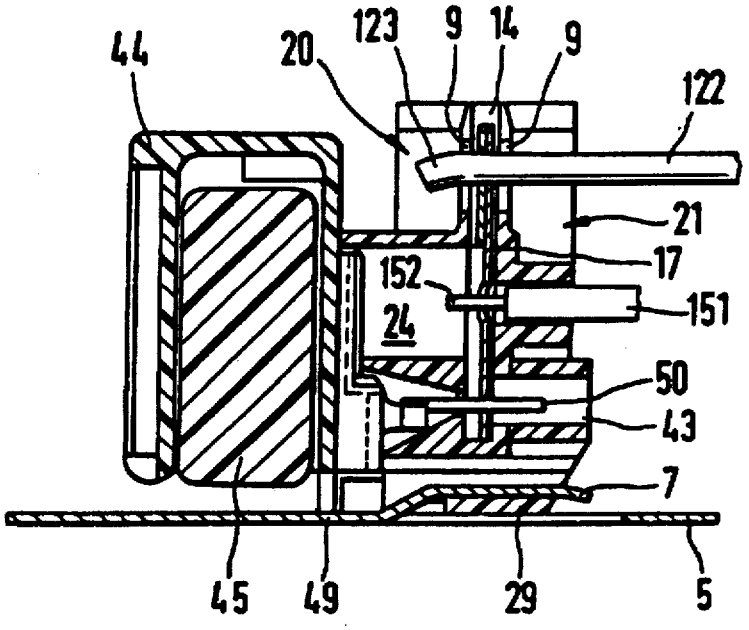
Figure 10:
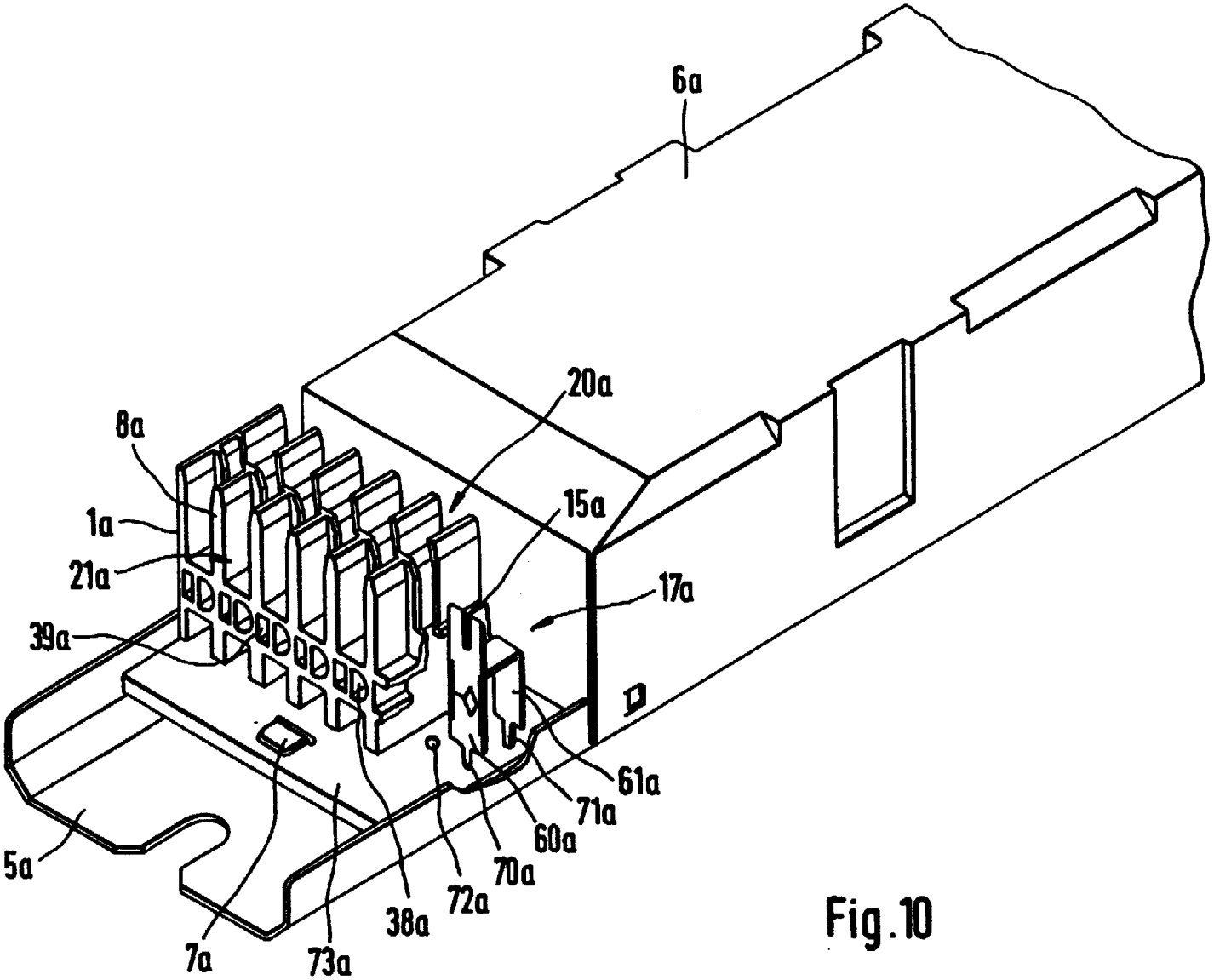
Figure 11:
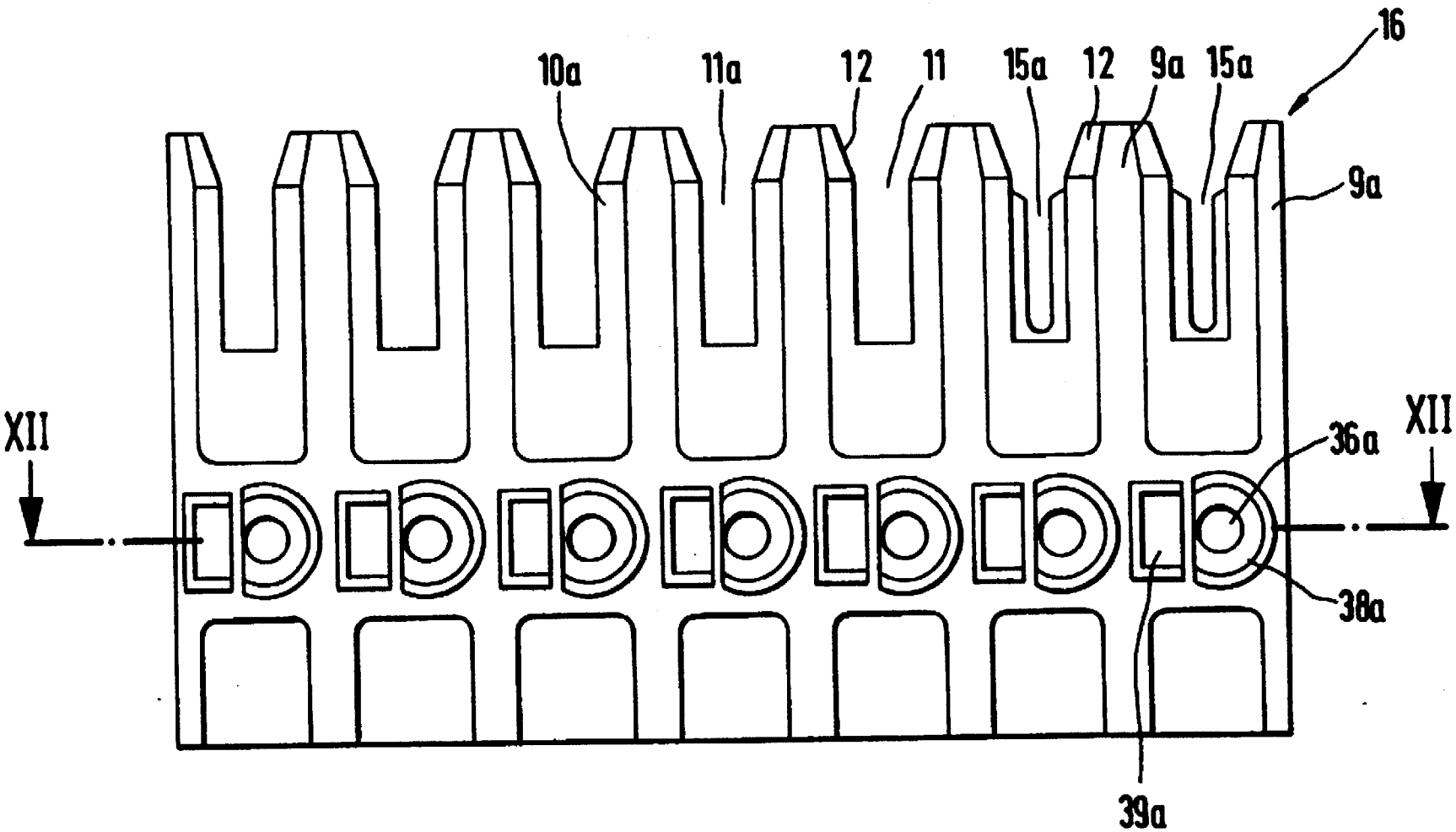
Figure 12:
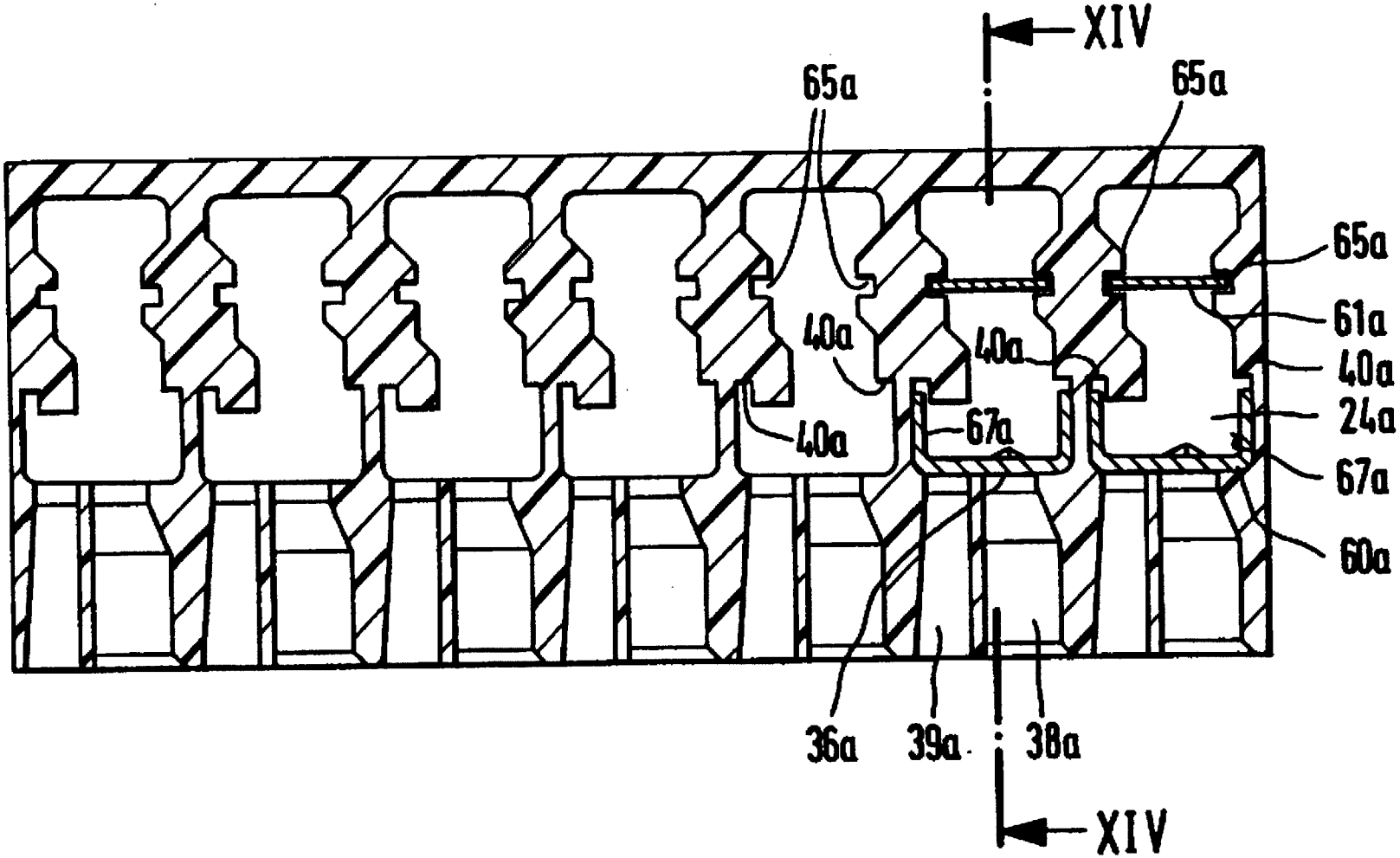
Figure 13:
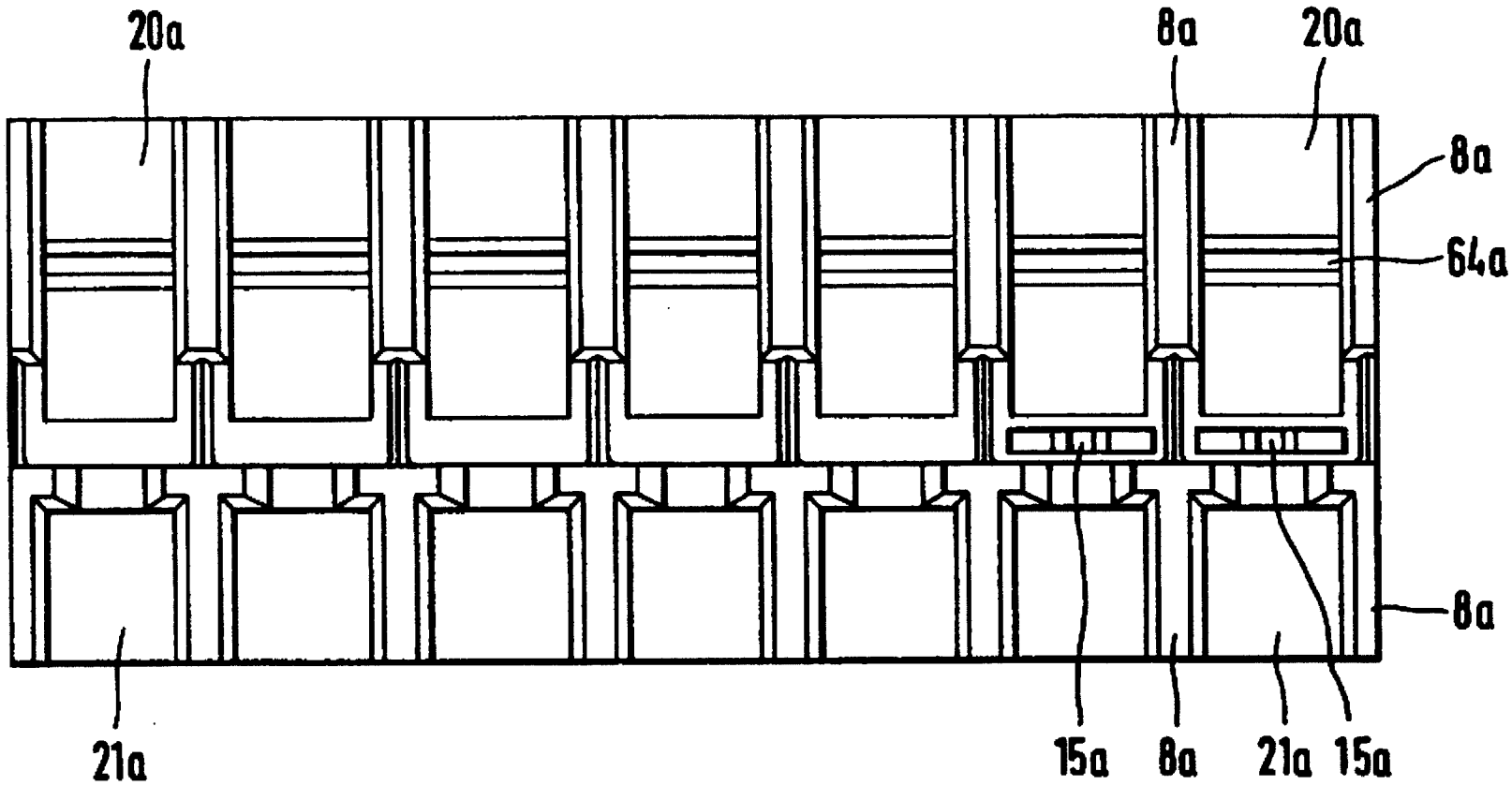

FIG. 5, in a side view on a different scale, is a sectional view of the arrangement of FIG. 3, taken along the line V—V of FIG. 3;

FIG. 6, in a side view on a different scale, is a sectional view of the connection clamp of FIG. 1, taken along the line VI—VI of FIG. 7;

FIG. 7 is a view of the connection terminal of FIG. 1, from the back, with the contact spring left out and on a different scale;

FIGS. 8 and 9 are a plan view and side view, respectively, on a different scale, of the contact spring of the connection terminal of FIG. 1;

FIG. 10 is a perspective schematic view, partly as a detail, of a connection device according to the invention in a different embodiment, in combination with an electrical accessory circuit system for gas discharge lamps;

FIG. 11, in a view from the front, shows the connection device of FIG. 10 with some of the contact springs left out;

FIG. 12 is a plan view of the connection device of FIG. 11, in a section taken along the line XII—XII of FIG. 11;

FIGS. 13 and 14 are plan views of the connection device of FIG. 11;

FIG. 15 is a side view or a sectional view, taken along the line XIV—XIV of FIG. 12 and on a different scale, of a contact spring of the connection device of FIG. 10;

FIG. 16 is a side view of the contact spring of FIG. 14, in a section taken along the line XV—XV of FIG. 14; and FIG. 17 is a side view of the contact spring of FIG. 14.

DETAILED DESCRIPTION

The novel connection terminal arrangement, shown in the form of a single-pole connection terminal particularly in FIGS. 1, 3 and 6 and 7, has a housing 1 made of insulating material, of essentially rectangular cross section, which on both opposed sides has two parallel formed-on base strips 2 and is provided with fastening means in the form of a continuous longitudinal slit 4 of rectangular cross section located in the vicinity of the flat bottom face 3. As seen in FIG. 3, the connection terminal is mounted with its bottom face on the base plate 5, for instance, of an electrical accessory circuit system 6 and secured to it by means of a tab 7 bent upward out of the base plate; the tab protrudes through the longitudinal slit 4 and is optionally bent slightly downward on its free end.

The two side bars 8 of the housing 1, which is open at the top toward its wire insertion side, have two opposed ribs 9 on their inside. Ribs 9 are located approximately in the middle between the two end faces 10 of the housing. The ribs 9, between them, define a slightly wedge-shaped or parallel-sided insertion slit or groove 11 (FIGS. 1 and 11), which is widened on its top by insertion slopes 12.

Two opposed narrow grooves 14 (FIGS. 1, 6) extend continuously from below across the height of the housing into the ribs 9; they receive the two legs 16 of a slit-blade insulation-piercing connector, or contact, which is located on a contact spring 17 (FIGS. 8, 9) of spring steel or spring bronze or some other conductive resilient material, the legs 16 defining a peripherally open insulation piercing slit 15. The contact spring 17 is in the form of a flat spring or small spring plate. The narrow contact spring 17 in the form of a small plate is embedded, in the manner visible from FIG. 6, in the housing 1 on all sides into the insulating material of the housing, except for the cut segments formed on the legs 16 and oriented toward the insulation piercing slit 15; the two legs 16 are limitedly movably guided in the grooves 14. In the region of the insulation piercing slit 15, the contact spring is folded over by 180° at 18 (FIGS. 6, 9) and is provided on the folded-over part on both sides of the insulation piercing slit 15 with two notched locking tabs 19 protruding obliquely over the plane of the foldover; these tabs serve to provide fixed-position fixation of the contact spring 17 in the housing 1. By means of the folded-over region 18, the cutting edges that define the insulation piercing slit 15 are doubled in number, so that a total of four connections for a pressed-in conductor result; these connections face one another in pairs.

As can be seen particularly from FIGS. 1, 5 and 6, the housing 1 has one groovelike indentation 20, 21 of essentially rectangular or slightly wedgelike convergent cross section, each adjoining one side of the ribs 9 and thus of the insertion or groove 11; the indentation opens, next to the insertion groove 11, toward the line insertion slit located at the top of the housing 1. The two groovelike indentations 20, 21 are in alignment with one another and with the insertion groove 11. At the top, they are also defined by an insertion slope 22. FIG. 3 in particular shows that the depth of the two groovelike indentations 20, 21 is greater than that of the insertion groove 11, but the groovelike indentation 21 that opens on the front face end is deeper than the other groovelike indentation 20 leading to the back. The width of the groovelike indentations 20, 21 is substantially greater than that of the insertion groove 11.

The dimensions of the various parts are chosen such that when an insulated line 122 is pressed through the insertion groove 11, in the manner seen in FIG. 5, the insulation is slit open in the insulation piercing slit 15 by the legs 16 of the slit-blade insulation-piercing contact 17, and at the same time gas-tight contacting takes place between the slit-blade insulation-piercing contact and the metal conductor of the line 122, this conductor being deformed at the clamping point. With its insulation, the pressed-in line 122 is at the same time firmly clamped between the two ribs 9 in the insertion groove 11. The thus-fixed, connected line 122 extends through the groovelike indentation 21, while its severed end 123 is located in the other groovelike indentation 20 (FIG. 5). The width and depth of the groovelike indentations 20, 21, as well as their axial length, are dimensioned such that shock hazard protection is automatically achieved for the line and in particular for its severed end 123. This means that the standardized feeling finger in when checking for shock hazard proofness cannot penetrate as far as the bared, severed end face of the end 123 of the line 122 at the depth of the associated groovelike indentation 20. The metal slit-blade insulation-piercing contact at the contact spring 17 itself is fully protected from the outside by its legs 16 in the grooves 14 of the housing 1 of insulating material. It is located at a depth such that absolute protection against shock hazard exists even in the region of the insertion groove 11.

Two chambers 24, 25, (FIG. 6) one above the other, are formed in the housing 1 below the part of the housing described above, containing the insulation piercing slit 15 and the groovelike indentations 20, 21; these chambers 24, 25 are of essentially rectangular cross section and open in the flat vertical back side of the housing. The two chambers 24, 25 are traversed by the vertically installed contact spring 17 in the form of a small plate, which is seated by its lower face end on the bottom of an indentation 26 provided on the underside of the second chamber 25. In this way, the contact spring 17 is properly supported in the housing in the axial direction against the effect of the pressure force exerted upon insertion of the conductor into the insulation piercing slit 15, so that the contact spring 17 cannot yield axially. At the same time, it is guided in the grooves.

In the region below the insulation piercing slit 15 and the foldover at 18, the contact spring 17 is formed with three plug-in connectors 27, 28 and 29, in the manner seen particularly from FIGS. 8 and 9. The two plug-in connectors 27, 28, located side by side, serve to connect electrical lines, while the plug-in connector 29 located below them, in the plane of symmetry with the insulation piercing slit 15, is intended for connection to a suitably formed electrically conductive connection part of an apparatus, herein termed accessory apparatus, such as the accessory circuit system 6 (FIG. 3). This connection part may also be a connecting wire, and very generally a line can be connected nondisconnectably at the plug-in connector 29.

The plug-in connectors 27, 28 are identical in form. They each have two essentially T-shaped tabs 35, defined by rectangular apertures and stamped-through separating lines 32, 33, 34, extending at right angles to one another; in the region of the crossbar 33, in an essentially triangular region, these tabs are marked out slightly obliquely inwardly.

In a similar way, two essentially T-shaped tabs 38, cut out laterally by lateral rectangular recesses 36 and separating lines 37, are formed at the apparatus connector at 29; these tabs 38 face one another and between them define a narrow gap 39, aligned with the insulation piercing slit 15 and having an approximately square enlargement in the middle. The two tabs 38 are likewise stamped, inclined obliquely outward from the plane of the contact spring 17, but in the other direction from the upper tabs in the region 35, as can also be seen in FIG. 9.

FIGS. 6 and 7 show that the upper two plug connectors 27, 28 are located approximately on a center axis of the chamber 24 and are aligned with two horizontal insertion openings 36 in the end wall of the chamber; these openings 36 are adjoined by insertion channels 38 of circular cross section, which widen in funnel-like fashion toward the front of the terminal. A rectangular aperture in the end wall of the chamber is provided between the insertion channels, and this aperture leads to the front side of the contact spring 17 and makes it possible to introduce a disconnection tool, such as a screwdriver, and press it against the T-shaped tabs of the plug contacts 27, 28 in the region of the separating line 33, so that a conductor locked between these contacts can be disconnected.

In order to prevent the contact spring from being excessively bent under the influence of the pressure force exerted with the disconnection tool, this spring is locally supportable, on its side opposite the wire insertion openings 36, by four support strips 40 formed on in the corners of the chamber 24, and the contact spring 17 can rest on the face ends of these support strips.

The apparatus connection 29, likewise formed as a plug-in connection, is located centrally in the lower chamber 25 (FIG. 6) opposite which on the other side of the contact spring 17 is an opening 42 (FIGS. 3, 6) of rectangular cross section leading to the front side of the housing; by way of example, this opening allows the insertion of a testing tip, in order to check the operating state of the apparatus connected. The opening 42 is defined by housing walls whose length is dimensioned such that the contact spring 17 is received in such a way that it is shock hazard protected from the outside. The chamber 25 is formed with an insertion funnel 43, opening toward the back of the housing, which makes it easier to install the connection terminal on an apparatus.

The longitudinal slit 3, formed as a parallel continuous channel is located under the chamber 25 and serves to secure the connection to tab 7, as has already been explained.

Figure 4:
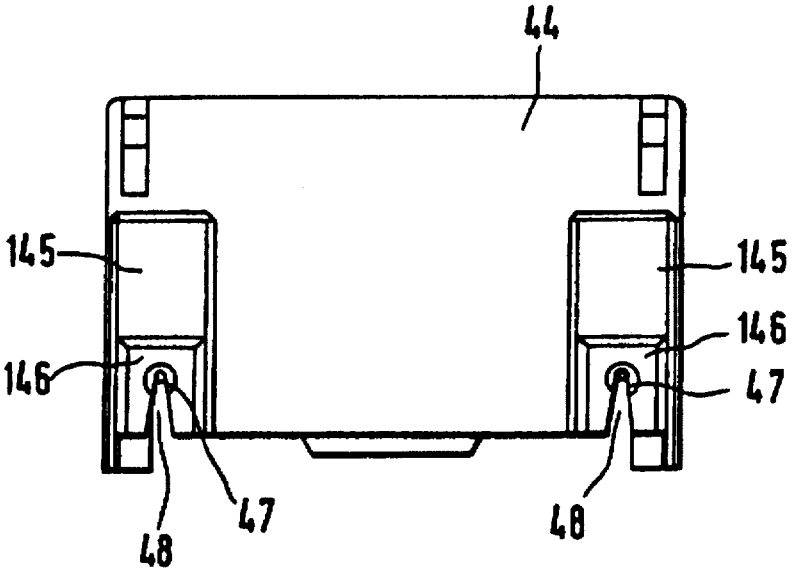
FIG. 4 is a side view of a covering cap of the accessory circuit system of FIG. 3.

The connection terminal described can be used universally, as has already been indicated. Its special advantage is the use with the accessory circuit system 6, as will be explained below in conjunction with FIGS. 3–5:

The accessory circuit system 6, for example, includes a lamination packet which is provided on both sides with one covering cap 44 each, made of insulating material and essentially rectangular, for a coil or winding form end shown schematically at 45 in FIG. 5. On the connection side, shown in FIG. 3, the covering cap 44 is provided on its front with two parallel vertical formed-on guide strips 145 adjoining the side walls; they protrude from the plane of the front wall and are defined with parallel sides. Each of the guide strips 145, in its lower region, has an extension 146 of essentially rectangular cross section, on which in turn a formed-on, horizontally aligned, protruding small tube 47 is seated, which is provided on its underside with an insertion slit 48 extending all the way through across the length and opening into the interior of the covering cap 44 that contains the winding form end 45.

The connection wires 49 of the coil of the accessory circuit system 6 are extended outward through the two insertion slits 48. They are each electrically conductively connected to a respective cable and sleeve 50, which is crimped onto the associated length of tube 47 and thus firmly joined to the covering cap 44.

When the connection terminals are installed on the thus pre-mounted accessory circuit system 6, each connection terminal is simply placed on the bottom plate 5 and thrust onto the covering cap 44, whereupon the fastening tabs 7 enter the longitudinal slit 3. The dimensionally stable cable end sleeve 50, protruding in pinlike fashion, is then automatically introduced through the insertion funnel 43 into the chamber 25 and from it into the plug point forming the apparatus connector 29 and contacted with the contact spring 17. When the connection terminal is thus pressed against the covering cap 44, the two T-shaped tabs 38 of the contact spring 17 are spread outward into the opening 43, in the manner visible in FIG. 5. In the process, they lock form-fittingly to the cable end sleeve 50, forming a nondisconnectable connection between the cable end sleeve 50 and the contact spring 17. When the contact spring 17 is thrust onto the cable end sleeve 50, this sleeve is scraped bare by the sharp edges of the T-shaped tabs 38, which edges slide with initial stressing on the sleeve and are sharp because of the angular widening in the middle of the gap 39 (FIG. 8); any painted parts that may be present are automatically removed, thus assuring satisfactory contacting.

The connection terminal slipped onto the covering cap 44 is designed such that in a connection region 51 (FIGS. 6, 7) of substantially rectangular cross section on its back side it fits precisely over the respective guide strip 45, as can be seen from FIG. 5. This not only assures a form-fitting retention of the connection terminal housing 1 at the covering cap 44, but simultaneously prevents the creation of impermissible leakage paths. Moreover, satisfactory shock hazard protection is provided at these points as well.

Lines can be connected to the two plug contacts 27, 28 from outside, as shown in FIG. 5 for a line 151, whose insulation is held in the applicable insertion channel 38, while its conductor 152 penetrates the contact spring 17 in one of the triangular regions 35 (FIG. 8) and is locked by the T-shaped tabs that spread obliquely inward in a spring-elastic fashion.

The clamping can be disconnected, in the manner already described, by means of a disconnection tool introduced through the recess 39 (FIG. 7).

Figure 2:
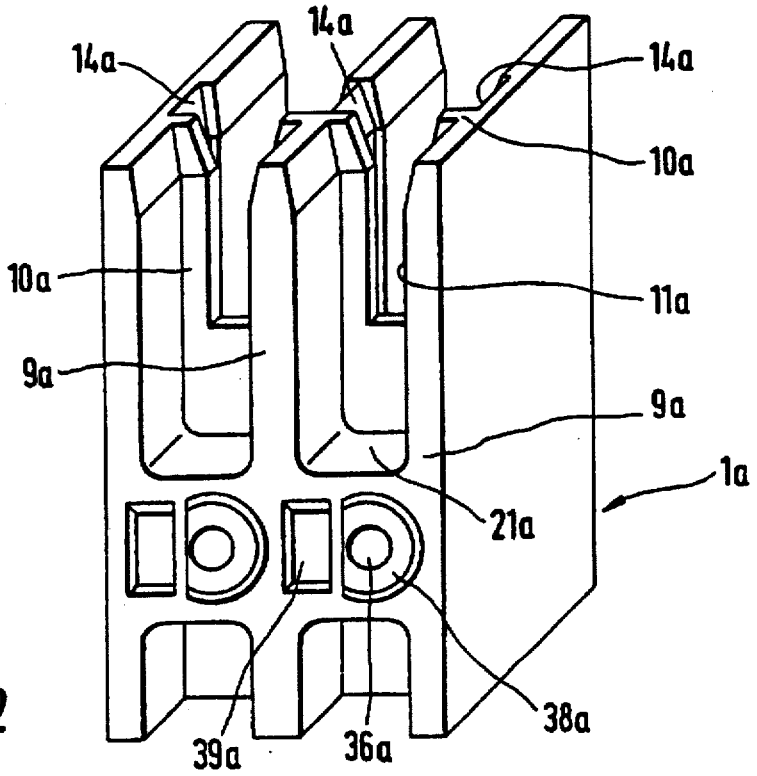
FIG. 2 is a perspective view of a connection device according to the invention in its embodiment as a two-pole apparatus connection terminal.

The connection terminal described may naturally also be formed as a two- or multi-pole connection terminal, as the second exemplary embodiment described below shows; a variant with two poles is shown in FIG. 2, and a variant with seven poles is shown in FIGS. 10–14.

Elements that are the same as in the embodiment of FIG. 1 are provided with the same reference numerals in the description of the embodiment of FIGS. 10–13, but merely followed by the letter "a". It is unnecessary to describe the structure and function of these identically numbered parts again; reference is made to the descriptions above.

While in the embodiment of FIG. 1 the apparatus connection at 29 is formed as a plug-in contact and the connection terminal can be used together with a accessory circuit system 6 in the manner visible in FIG. 5, the embodiment of FIGS. 1–14 is intended particularly for use together with circuit boards, printed circuits and the like, as can be seen especially from FIG. 10.

In the housing 1*a* (FIG. 2) or 1*b* (FIGS. 10–13) of insulating material, here in the form of a clamping strip, a plurality of slit-blade insulation-piercing contacts, electrically separated from one another, are located side by side in a row in segments of the housing that are identical to one another. It will therefore suffice to describe one such housing segment for only one slit-blade insulation-piercing contact:

The upper part of the housing 1a, 1b is designed as open toward the line insertion side, essentially similarly to FIG. 1. One insertion slit 11a is defined between each two side walls 9a between the ribs 10a, and next to the slit, two narrow grooves 14a are provided for receiving a corresponding segment of a contact spring 17a (FIGS. 14–16). In the region of each insertion slit, the contact spring 17a has an insulation piercing slit 15a that is in alignment with the insertion slit and that is defined on each of the two sides by a respective leg 16a. In the housing 1a, 1b, on both sides of the slit-blade insulation-piercing contact, there are two elongated groove-like indentations 20a, 21a (FIG. 13), whose length, width and depth are dimensioned similarly to those of the embodiment of FIG. 1.

Below the two groovelike indentations 20a, 21a, there is one chamber 24a in the housing 1a, 1b for each contact spring 17a, and opening into this chamber from the front side of the housing are an insertion opening 36a and a line insertion channel 38a (see FIG. 15). Once again, a rectangular aperture 39a for the insertion of a disconnection tool (FIG. 2) is provided next to the line insertion channel (38a).

As can be seen particularly from FIGS. 15–18, the contact spring 17a is bent substantially in a U; it has two legs 60a, 61a, which are joined together by a crosspiece 62a which is adjoined by a flat double-walled region 63a, located in the extension of the leg 60a and containing the insulation piercing slit 15a. This assures that in this embodiment as well, contacting of the conductor, connected by the slit-blade insulation-piercing technique, takes place at four separate connectors.

FIGS. 14, 15 show that the contact spring 17a, which is essentially in the shape of an h, is thrust from above into the housing 1a, 1b, with its first leg 60a traversing the chamber 24a and its second leg 61a received in a transverse slit 64a provided in the bottom of the groovelike indentation 20a. Two guide grooves 65a (FIG. 12), which laterally guide the leg 61a, are associated with the transverse slit 64a in the side walls of the respective chamber 24a.

The other leg 60a, in the manner shown in FIGS. 15, 17, is provided in its upper region with striplike wall parts 67a, bent perpendicularly backward toward the leg 61a, which serve to stabilize this region of the contact spring 17a and in the installed state, in the manner that can be seen in FIG. 12, rest laterally against the walls of the chamber 24a; their free long edges in the housing are associated with support points 40a, which prevent an impermissible deformation of the contact spring 17a under the influence of a disconnection tool introduced through the aperture 39a, as has also already been explained.

In the region of the chamber 24a, a plug-in contact 27a is formed in the leg 60a of the contact spring 17a and is aligned with the line insertion opening 36a. The plug-in contact 27a is similar in form to the plug-in contact 27 of FIG. 8, so it will suffice to indicate the respective identical reference numerals. Once again, it has two substantially T-shaped notched tabs 270a, which are separated from one another by a transversely extending separating line 33a and which in the manner visible from FIG. 15 are stamped out, inclined inward obliquely relative to the plane of the leg 60a. Locking tabs suggested at 19a (FIGS. 15, 17) serve to provide stationary locking of the contact springs 17a in the housing 1a, 1b.

The two legs 60a, 61a are each provided with a respective base pin 70a, 71a on their lower ends, which protrudes somewhat past the underside of the housing and is beveled somewhat on one side.

As seen particularly from FIG. 15, the contact spring 17a is supported in the housing 1a, 1b in the axial direction by the crosspiece 62a of its leg 60a on the bottom of the groovelike indentation 20a, so that it can readily withstand the strains acting in the axial direction when a conductor is clamped in the insulation piercing slit 15a. The contact springs are inserted by their base pins 70a, 71a, in the manner visible from FIG. 10, into corresponding openings 72a of a circuit board 73a, onto which the connection terminal arrangement is placed with its housing 1a, 1b. In this case, again, the circuit board 73 serves to provide electrical connection of the accessory circuit system suggested at 6a, which being formed for instance as an electronic accessory circuit system can contain a number of electrical components that require their own connections. Individual slit-blade insulation-piercing contacts of the connection device can selectively also be used as a line support point for the further wiring of the entire light fixture.

The circuit board 73a is located on the mounting rail 5a of the accessory circuit system 6a and locked by means of at least one tab 7a notched thereon, which protrudes through a corresponding slitlike opening in the circuit board 73a and bent over it.

Especially simple construction conditions are achieved if the contact spring 17 is a flat spring. The contact spring 17, 17a may be folded over by 180° in the region of the slit-blade insulation-piercing slit 15, 15a, in order to assure an improvement in contact making with the conductor to be connected (in this respect, see German Patent Disclosure Document DE-OS 2 330 159).

The housing that receives the contact spring, in a suitable embodiment, has at least two chambers disposed one above the other, which are traversed by the contact spring and of which one chamber includes the plug-in contact and the other the apparatus connection contact; lead-ins for the parts to be connected are assigned to the chambers, and if needed, supporting guide devices for the contact spring are also provided. For reasons of space, it is practical as a rule if the two chambers 24, 25 are located below the housing part containing the slit-blade insulation-piercing contact. To prevent the contact spring from yielding when the conductor is pressed into its slit-blade insulation-piercing slit, the contact spring is advantageously supported in the lowermost chamber counter to a force acting on the slit-blade insulation-piercing slit in the longitudinal direction of the contact spring.

Often it is also necessary to make provisions to prevent plastic bending of the contact spring from excessive exertion of force on the disconnection tool when the plug contact is disconnected; this could damage the connection device or even make it unusable. To prevent that, the contact spring 17, 17a is supported in the chamber associated with the plug-in contact 27, 28; 27a, counter to the direction of the pressure force of the disconnection tool. This support can be provided at locally defined support points 40 on the walls of the chamber 25, and the location of these support points depends on the special embodiment of the disconnection or unlocking region, which in turn depends on the form of the tabs and the course of the parting lines for where they are cut out.

If the apparatus connection contact is formed as a plug contact, as mentioned, then it is often advantageous if this apparatus connection contact and the plug contact that is also otherwise present are formed with opposed insertion directions for the parts to be connected, so that their insertion openings for the parts to be connected are also located on opposite sides of the housing.

A transversely extending opening or recess 3 can be formed in the housing 1 for receiving a fastening means 7 on the side toward the apparatus, to enable securing the connection terminal arrangement mechanically as well, without additional devices.

Particularly if it is important to use the connection device in combination with circuit boards or printed circuits, a different embodiment of the apparatus connection contact is practical. In such cases, the apparatus connection contact may have at least one base pin 70*a*, 71*a* protruding from the housing 1*a*, *b*, which is arranged for a solder or clamping connection of a part to be connected and at the same time, if necessary, can also be used for mechanically connecting the connection device to the circuit board and so forth.

As a rule, this base pin 70*a*, 71*a* is notched at the contact spring 17*a* and is formed accordingly. In principle, it can naturally also be joined to the contact spring and in that case optionally made from some different material.

To improve the mechanical strength of the connection of the connection terminal arrangement to a circuit board and optionally to create further electrical connection possibilities, for instance in cases of very high current load, it can also be practical that the contact spring 17*a* is essentially U-shaped, with a double-walled segment 63*a* extending away from the base 22*a* of the U-shaped part and containing the slit-blade insulation-piercing slit 15*a*, wherein the base pins are notched at the two legs 60*a*, 61*a*. This produces a support at two spatially separated points for each contact spring, at which points both electrically conductive parts can be connected.

The additional plug contact is suitably formed on one of the two legs of the contact springs, but the option also exists of providing plug contacts on both legs.

The possible uses of the novel connection device are practically unlimited. The connection device is suitable for all wiring layouts in low-voltage circuits, e.g. circuits for network voltages, usually 110 or 220 V, and is especially attractive for automatic production of such wiring layouts by means of a wire placement tool guided in programmed fashion by a robot.

Since the connection device is directly provided with at least one apparatus connection contact, it is often advantageous to secure the connection device directly to the apparatus itself; it is sometimes appropriate to take provisions on the connection side of the apparatus itself for secure connection of the novel connection terminal arrangement.

One such general use is in combination with an accessory, or ballast circuit system for gas discharge lamps, e.g. fluorescent lamps, or a low-voltage transformer, because in such equipment the manufacturer as a rule already provides an connection terminal arrangement, often in the form of an insulated screw connector, which is permanently mounted to the lamination packet or to a base plate. In one embodiment, widely used in the industry, of this kind of accessory circuit system or transformer, caps of plastic are provided for insulating the winding form ends; these caps are mounted on the lamination packet adjacent to the respective winding form end. As described in this respect in German Patent 2 244 158, Albeck, it is known to provide protrusions or lengths of tubing that protrude in pinlike fashion onto the connection-side cap of insulating material; these protrusions or tubes have a slit at the bottom into which a winding wire is placed; then a cable end sleeve is mounted and secured to the protrusions or length of tube by crimping, and thus is mechanically firmly retained on the protrusion or length of tube, and in this way the winding wire is electrically connected to it.

The novel connection device can now be mounted with its apparatus connection contact directly on the connection part formed by this cable end sleeve and nondisconnectably locked to it. This kind of direct plug connection is also possible in any apparatus in which a pinlike or pluglike connection part is present onto which the connection device can be mounted directly.

For additional mechanical guidance and to avoid leakage paths, it is advantageous if the cooperating guide and/or retention elements 145, 146; 51 are formed on the covering cap 44 of the aforementioned accessory circuit system and the housing 1*a*, 1*b* of the connection terminal arrangement.

In principle, it is also possible, in this kind of accessory circuit system or transformer, to make the external line connection via a circuit board, which by way of example is mounted on the base plate in an electrically insulated fashion and can then carry additional circuit elements that the manufacturer associated with the accessory circuit system or transformer. In that case, the second embodiment discussed at the outset, with the base pins located on the contact spring, is attracted.

Various changes and modifications may be made, and any features described herein in connection with any one embodiment may be used with any of the others, within the scope of the inventive concept.

We claim:

1. An electrical connection terminal arrangement having a housing of insulating material, which has at least one insertion slit, open at an edge toward one insertion side for an electric wire and at least one slit-blade insulation-piercing connector located in the housing, said slit-blade insulation-piercing connector (17) having two connector legs (16, 16*a*) and a slit-blade insulation-piercing slit (15, 15*a*) open at the edge and aimed at the insertion slit for an electric wire connection formed between said connector legs (16, 16*a*), at least portions of said legs (16, 16*a*) adjacent said insulation-piercing slit (15, 15*a*) forming a contact zone, wherein the slit-blade insulation-piercing connector is formed on a contact spring (17, 17*a*), wherein the contact spring (17, 17*a*) additionally has at least one plug-in contact (27, 28; 27*a*);

a contact (29, 70*a*, 71*a*) for an accessory apparatus connection; and a groove-like indentation (20, 21; 20*a*, 21*a*) formed on at least one side in a portion of the housing (1) receiving the slit-blade insulation-piercing connector (17) adjoining the insertion slit (11, 11*a*), which is deeper and wider than said insulation-piercing slit (15, 15*a*), and positioned closely adjacent said insulation-piercing connector (17), the length, depth and width of said indentation (20, 21; 20*a*, 21*a*) being dimensioned such that a cut end of the electric wire placed therein is received within the indentation in an electrical shock-hazard proof manner;

wherein the housing is formed with at least one chamber (24, 25) located beneath the groove-like indentation (20, 21; 20*a*, 21*a*) and having at least one access opening (36, 43) at a face of the housing;

wherein at least one of the plug-in contacts (27, 28; 27*a*) and the accessory apparatus connection contact (29, 70*a*, 71*a*) is located in said at least one chamber below the slit-blade insulation-piercing connector (17) and the slit-blade insulation-piercing slit (15, 15*a*) thereof; and wherein the accessory apparatus connection includes at least one base pin (70*a*, 71*a*) protruding from the housing.

2. The connection terminal arrangement of claim 1, wherein said base pin (70*a*, 71*a*) is formed by a cut portion of said contact spring (17*a*).

3. The connection terminal arrangement of claim 2, wherein the contact spring (17*a*) is essentially U-shaped defining two legs (60*a*, 61*a*) and a base (62*a*);

a double-walled segment (63*a*) extending away from the base (62*a*) of the U-shaped contact spring (17*a*), said double-walled portion including said slit blade insulation-piercing slit (15*a*); and wherein said legs (60*a*, 61*a*) are notched intermediate their length to form said at least one base pin (70*a*, 71*a*).

4. The connection terminal arrangement of claim 3, wherein at least one of the plug-in contacts (27*a*) is formed on one leg (60*a*).

5. The connection terminal arrangement of claim 1, in combination with:

an accessory circuit system or transformer;

wherein a circuit board (73*a*) of insulating material is connected to the accessory circuit system (6*a*) or transformer and has openings (72) for receiving the base pins (70*a*, 71*a*), which are connected or contacted with connection parts of the accessory circuit system or transformer.

6. The connection terminal arrangement of claim 1, characterized in that at least one of the plug-in contacts (27, 28; 27*a*) is formed with a disconnectable conductor connection.

7. The connection terminal arrangement of claim 1, characterized in that the plug-in contact for the apparatus connection (29, 70*a*, 71*a*) is arranged for non-disconnectable connection of a connection part of an apparatus (6, 6*a*).

8. The connection terminal arrangement of claim 1, characterized in that the plug contact (27, 28, 27*a*) is formed by cut-out tabs, which spread apart when a connection part is inserted in the contact spring (17, 17*a*), said tabs being accessible to a disconnecting tool from the outside of the apparatus, and in that the tabs are formed to be elastically deformable in disconnection direction by a pressure force acting in the unlocking direction.

9. The connection terminal arrangement of claim 8, characterized in that the contact spring (17, 17*a*) is supported in a region of the plug contact (27, 28; 27*a*) counter to a direction of a force exerted by a disconnection tool.

10. The connection terminal arrangement of claim 1, characterized in that the contact spring (17) is a flat spring.

11. The connection terminal arrangement of claim 1, characterized in that the contact spring (17, 17*a*) is folded over by 180° in a region of the slit-blade insulation-piercing slit (15, 15*a*).

12. The connection terminal arrangement of claim 1, characterized in that the housing has at least two chambers (24, 25), located one above another, which are traversed by the contact spring (17) and of which one chamber (24) includes the plug-in contact (27, 28) and the other chamber includes the apparatus connection contact (29), and that both chambers (24, 25) are formed with associated lead-ins for connection parts (50, 52).

13. The connection terminal arrangement of claim 12, characterized in that the two chambers (24, 25) are located below the groove-like indentations (20, 21, 20*a*, 21*a*) of the housing.

14. The connection terminal arrangement of claim 12, characterized in that a support is provided at locally defined support points (40) on walls of a chamber (25).

15. The connection terminal arrangement of claim 1, characterized in that the contact spring (17, 17*a*) is supported in the housing (1; 1*a*, 1*b*) counter to a force acting on the slit-blade insulation-piercing slit (15, 15*a*) longitudinally of the contact spring.

16. The connection terminal arrangement of claim 1, characterized in that lateral guide means, which are continuous on both sides, for the contact springs (17, 17*a*) containing the slit-blade insulation-piercing slit (15, 15*a*) are formed in the housing part and in at least one chamber (24, 24*a*) located beneath it.

17. The connection terminal arrangement of claim 1, characterized in that a transversely extending opening (3) is formed on the housing (1) for receiving an attachment element (7), optionally a tab, for attaching said arrangement on a support (5).

* * * * *